US005397060A

United States Patent [19]

Maas et al.

[11] Patent Number: 5,397,060

[45] Date of Patent: Mar. 14, 1995

[54] FOAM-SPRAY-OFF TRIGGER SPRAYER

[75] Inventors: Wilhelmus J. J. Maas; Petrus L. W. Hurkmans, both of Someren, Netherlands

[73] Assignee: AFA Products, Inc., Forest City, N.C.

[21] Appl. No.: 185,450

[22] Filed: Jan. 21, 1994

[51] Int. Cl.[6] ..... B05B 1/02; B05B 1/12; B05B 1/26

[52] U.S. Cl. ..... 239/333; 239/343; 239/428.5; 239/432; 239/504; 239/512; 239/514

[58] Field of Search ..... 239/333, 375, 395, 392, 239/391, 390, 438, 437, 456, 451, 343, 428.5, 432, 504, 507, 512, 514, 518

[56] References Cited

U.S. PATENT DOCUMENTS

| | | | |
|---|---|---|---|
| 4,646,973 | 3/1987 | Focaracci | 239/343 X |
| 4,767,060 | 8/1988 | Shay et al. | 239/428.5 X |
| 4,779,803 | 10/1988 | Corsette | 239/428.5 X |
| 4,883,227 | 11/1989 | Maas | 239/343 X |
| 4,925,106 | 5/1990 | Maas et al. | 239/333 |

FOREIGN PATENT DOCUMENTS

| | | | |
|---|---|---|---|
| 452208 | 10/1991 | European Pat. Off. | 239/343 |
| 8909655 | 10/1989 | WIPO | 239/333 |

*Primary Examiner*—Andres Kashnikow
*Assistant Examiner*—Lesley D. Morris
*Attorney, Agent, or Firm*—Thomas R. Vigil

[57] ABSTRACT

The nozzle assembly for a foam-spray-off trigger sprayer comprises a barrel with perforated end wall member and a nozzle member which has an elongate central axis and which is constructed to be mounted on the outer end of a nose bushing having liquid direction structure for directing liquid into a swirl. The nozzle member has a rear barrel portion and a front barrel portion with an internal wall therebetween. The internal wall has an orifice located on the central axis and is positioned to receive swirling liquid from the nose bushing for injection into the front barrel portion. The barrel with perforated end wall member includes an outer hollow cylindrical body and a transversely extending perforated wall mounted in the cylindrical body and structure for mounting the barrel with perforated end wall member for axial movement on and relative to the front barrel portion.

15 Claims, 6 Drawing Sheets

FOAM-SPRAY-OFF TRIGGER SPRAYER

BACKGROUND OF THE INVENTION

1. Field of the Invention.

The present invention relates to a foam-spray-off trigger sprayer having an axially movable perforated wall mounted for axial movement inside a front barrel of a trigger sprayer nozzle, whereby the movable perforated wall can be moved between (a) a stream position where a central opening in the perforated wall is positioned closely adjacent an outlet orifice in a back wall of a foam generating chamber defined within the front barrel to (b) a foam generating position where the perforated wall is positioned forwardly of the outward orifice where droplets of liquid impinge upon the perforated wall, are deflected and mix with air to form foam.

2. Description of the Related Art Including Information Disclosed Under 37 CFR §§1.97–1.99.

Heretofore there has been proposed a barrel with perforated end wall insert for use in a trigger sprayer to create a foam-off nozzle assembly in the Maas et al. U.S. Pat. No. 4,925,106. As will be described in greater detail hereinafter, the movable perforated wall of the nozzle assembly of the foam-spray-off trigger sprayer of the present invention provides an improvement over the previously proposed fixed perforated wall whereby a foam, spray, off nozzle assembly for a trigger sprayer is provided.

Also there has been proposed in the Shay et al. U.S. Pat. No. 4,767,060 to provide an annular roamer which is mounted on a nozzle barrel and which has an inner annular sleeve that can be (a) axially positioned in the nozzle barrel and in the path of a vortical sheet of liquid for creating and dispensing foam or (b) axially positioned not to interfere with the vortical sheet of liquid to dispense liquid in a spray.

SUMMARY OF THE INVENTION

According to the present invention there is provided a nozzle assembly for a foam-spray-off trigger sprayer comprising a barrel with perforated end wall member and a nozzle member which has an elongate central axis and which is constructed to be mounted on the outer end of a nose bushing having liquid direction structure for directing liquid into a swirl. The nozzle member has a rear barrel portion and a front or forward barrel portion with an internal wall therebetween. The internal wall has an orifice located on the central axis and is positioned to receive swirling liquid from the nose bushing for injection into the front barrel portion of the nozzle member. The barrel with perforated end wall member includes an outer hollow cylindrical body and a transversely extending perforated wall mounted in the cylindrical body. The barrel with perforated end wall member has structure for mounting the barrel with perforated end wall member for axial movement on and relative to the front barrel portion.

DESCRIPTION OF THE PREFERRED EMBODIMENT(S)

Figure 1:
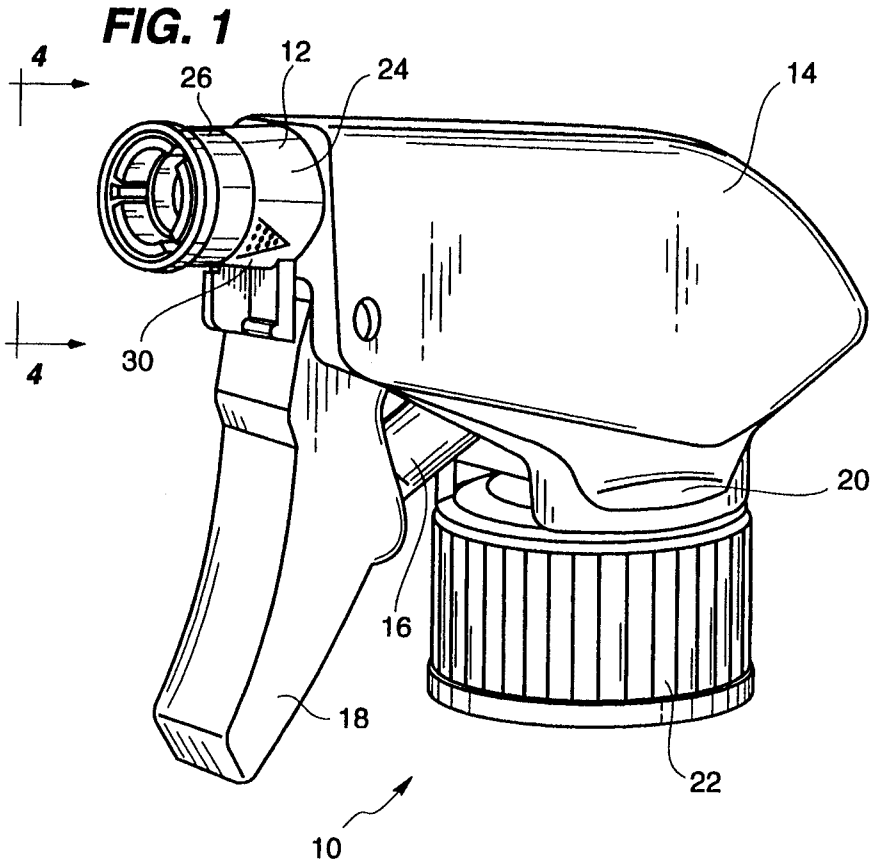
FIG. 1 is a right side perspective view of the foam-spray-off trigger sprayer of the present invention with the nozzle assembly thereof in a spray position.

Referring to the drawings now in greater detail, there is illustrated in FIG. 1 a foam-spray-off trigger sprayer 10 including a nozzle assembly 12 constructed according to the teachings of the present invention. The trigger sprayer 10 includes a body 14 having a cylinder therein (hidden from view) which receives a piston 16 that is acted upon by a trigger 18 operatively coupled to the body 14. The lower end 20 of the body 14 has a nozzle cap 22 mounted thereon for connecting the sprayer to a container (not shown) of liquid to be dispensed.

According to the teachings of the present invention, the assembly 12 includes a nozzle member 24 which is mounted onto a nose bushing (not shown) which can be of the type disclosed in the Maas et al. U.S. Pat. No. 4,925,106, the disclosure of which is incorporated herein by reference. The nozzle assembly 12 further includes a barrel with perforated end wall member 26 which is movably mounted on and relative to a front or forward barrel portion 28 of the nozzle member 24.

FIG. 1 shows the barrel with perforated end wall member 26 in an inner position defining a spray position which will be described in greater detail hereinafter in connection with the description of FIG. 5.

Figure 2:
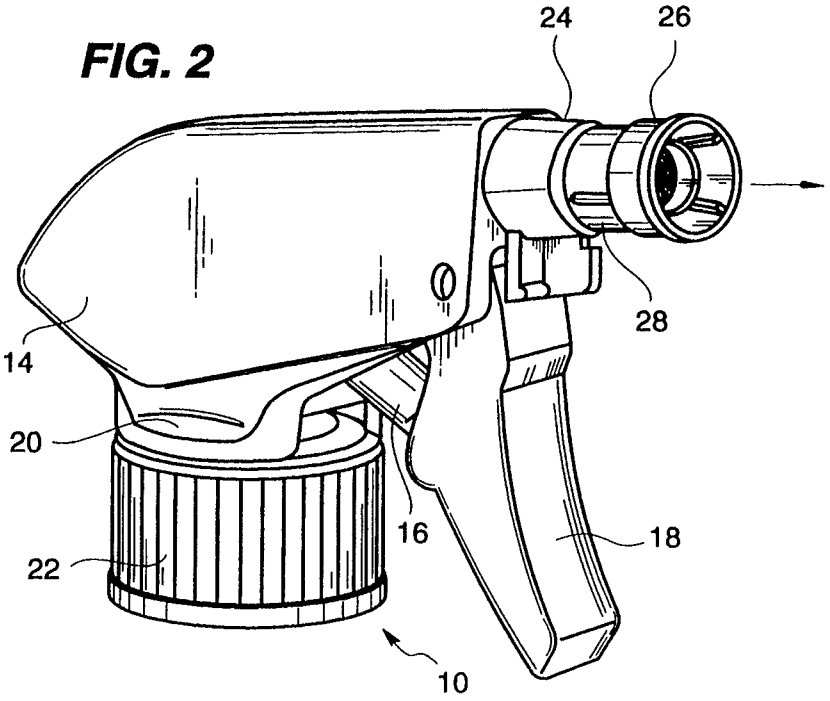
FIG. 2 is a left side perspective view of the foam-spray-off trigger sprayer of the present invention with the nozzle assembly thereof in a foam generating position.

FIG. 2 shows the barrel with perforated end wall member 26 in an outer position defining a foam generating position which will be described in greater detail hereinafter in connection with the description of FIG. 6.

As best shown in FIGS. 3, 6, 9 and 10, the nozzle member 24 further includes a rear barrel portion 30 (FIG. 6) as well as the front or forward barrel portion 28 which are separated by an internal wall 32 having a central orifice 34 extending therethrough. The orifice 34 (FIG. 5) has a tapered entry 36 that opens onto a rear face 38 of the internal wall 32 to a cylindrical opening 40 which opens onto a raised surface or boss 42 on a front face 43 of the internal wall 32.

Within the rear barrel portion 30 and extending rearwardly from the internal wall 32 is a rearwardly extending cylinder 44 that is integral with and extends rearwardly from the internal wall 32. This cylinder 44 defines an axially extending annular slot 46 between an inner periphery 48 of the barrel portion 30 and the outer periphery of the cylinder 44. The inner periphery 48 of the rear barrel portion 30 is formed with a shoulder 50 that snap fittingly receives a cylinder (not shown) projecting from the nose bushing (not shown). The nose bushing can be of the type shown in FIGS. 7, 8 and 11 of the Maas et al. U.S. Pat. No. 4,925,106.

Depending from the lower rear edge 51 of the rear barrel portion 30 is a diametrically and radially extending flange 52. Then a transversely and radially extending flange 54 extends axially forwardly from the diametrically and radially extending flange 52 and radially outwardly from the rear barrel portion 30.

Figure 3:
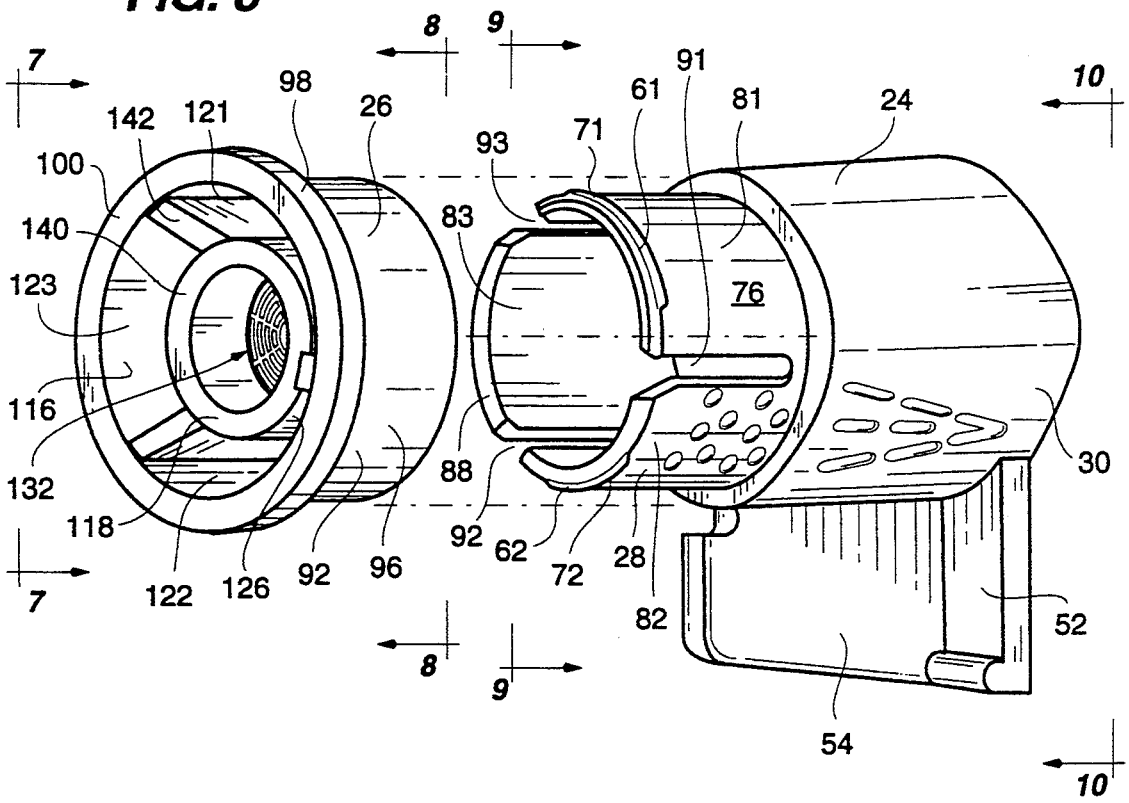
FIG. 3 is an exploded perspective view of the nozzle assembly constructed according to the teachings of the present invention.
Figure 4:
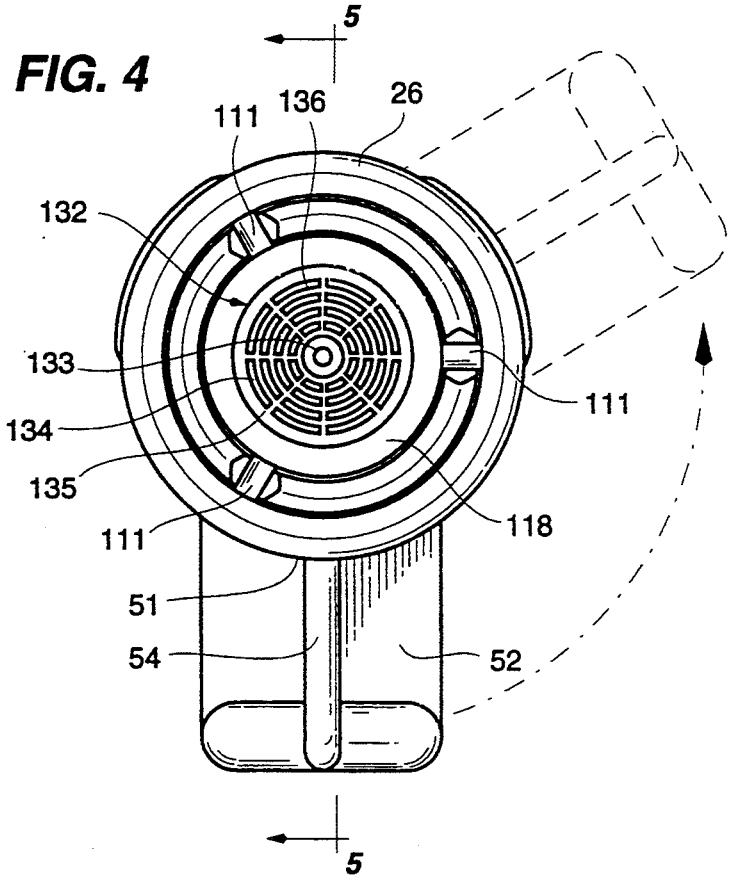
FIG. 4 is a front elevational view of the nozzle assembly shown in FIG. 1 and is taken along line 4—4 of FIG. 1.

The front barrel portion 28 extends forwardly from the internal wall 32 to arcuate flange portions 61–63 each extending radially outwardly and defining a shoulder 71–73 on the outer cylindrical surface 76 (FIG. 3) of each one of three partially cylindrical wall sections 81–83 respectively of the front barrel portion 28. An annular, tapered or beveled surface 86 (FIGS. 5 and 6) extends from each arcuate flange 61–63 to a front edge 88 of the front barrel portion 28. As best shown in FIG. 3, the front barrel portion 28 has three axially extending slots 91–93 therein which are equally spaced, e.g., 120° apart from each other, around the periphery of the front barrel portion 28 and divides the front barrel portion 28 into the three cylindrical wall sections 81–83.

Referring now to FIGS. 3, 6, 7 and 8, the barrel with perforated end wall member 26 includes an outer cylindrical body 96 having a radially outwardly extending annular flange 98 adjacent a front edge 100 thereof and a radially inwardly extending flange portion 102 adjacent a rear edge 104 thereof.

Figure 7:
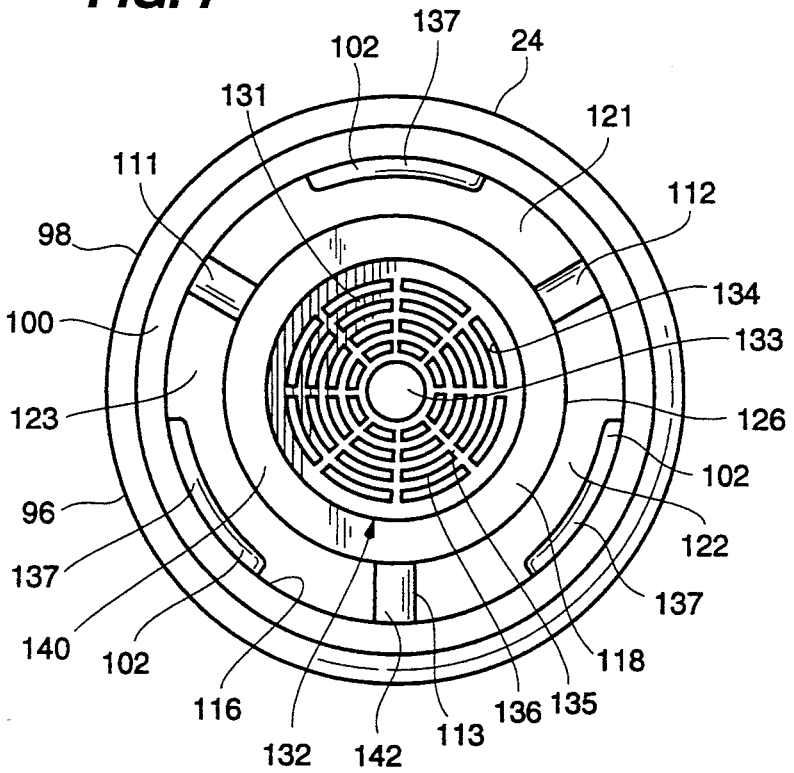
FIG. 7 is a front view of the barrel with perforated end wall member of the nozzle assembly shown in FIG. 3 and is taken along line 7—7 of FIG. 3.
Figure 8:
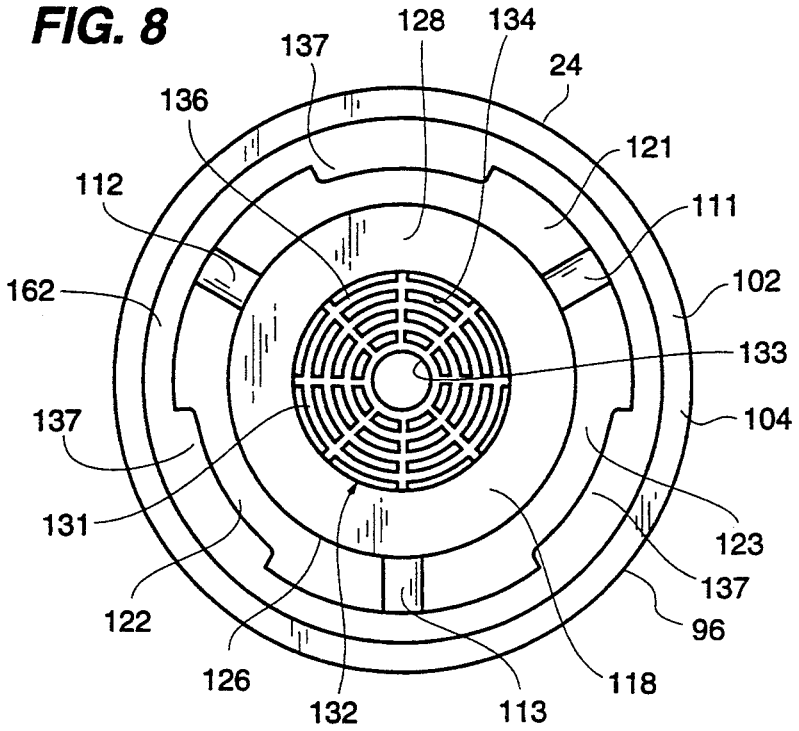
FIG. 8 is a rear view of the barrel with perforated end wall member of the nozzle assembly shown in FIG. 3 and is taken along line 8—8 of FIG. 3.
Figure 9:
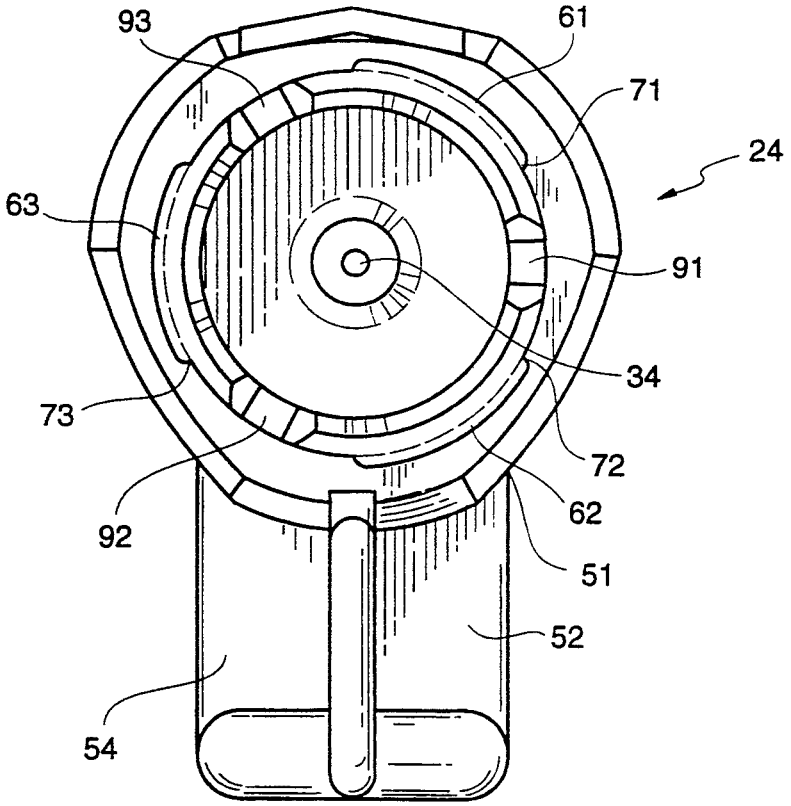
FIG. 9 is a front view of the nozzle member of the nozzle assembly shown in FIG. 3 and is taken along line 9—9 of FIG. 3.
Figure 10:
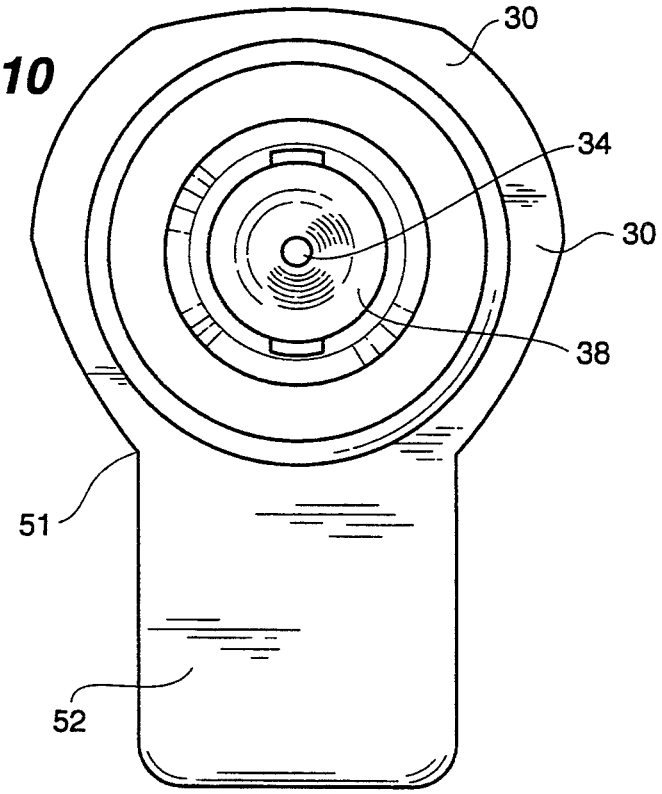
FIG. 10 is a rear view of the nozzle member of the assembly shown in FIG. 3 and is taken along line 10—10 of FIG. 3.

As best shown in FIGS. 7 and 8, three equally spaced apart (120° from each other) webbings 111, 112 and 113 extend radially inwardly from an inner surface 116 of the cylindrical body 96 to a short inner cylinder 118 within the cylindrical body 96. This construction defines three arcuate slots 121, 122 and 123 disposed circumferentially between the webbings 111, 112 and 113 and radially inwardly between an outer surface 126 of the short inner cylinder 118 and the inner surface 116 of the cylindrical body 96.

The short cylinder 118 has a rear wall 128 that is cut away on a rear face thereof forming a cavity 130. A front face 131 has perforations 132 therein which defines a perforated wall 132.

With reference to FIGS. 7 and 8, the perforations of the perforated wall 132 include a central opening 133 and arcuate slots or spaces 134 situated between eight (8) radial spokes or ribs 135 and three (3) or four (4) arcuate or concentric circular ribs 136. As disclosed in U.S. Pat. No. 4,925,106, the ribs 135 and 136 are rounded on the back side thereof to facilitate the deflection of liquid impinging thereon and the subsequent mixing of the liquid droplets with air to form foam.

The flange portion 102 that extends inwardly from the inner surface 116 of the cylindrical body 96 has a front edge 137 that is generally in line with the front face 131 of the rear wall 128 and the perforated wall 132 at the inner end of the short cylinder 118. The distance from the front edge 137 of the flange portion 102 to the front edge 100 of the cylindrical body 96 is approximately 4.5 millimeters and the distance from the front face 131 of the perforated wall 132 to a front edge 140 of the short cylinder 118 is approximately 2.5 millimeters.

Figure 6:
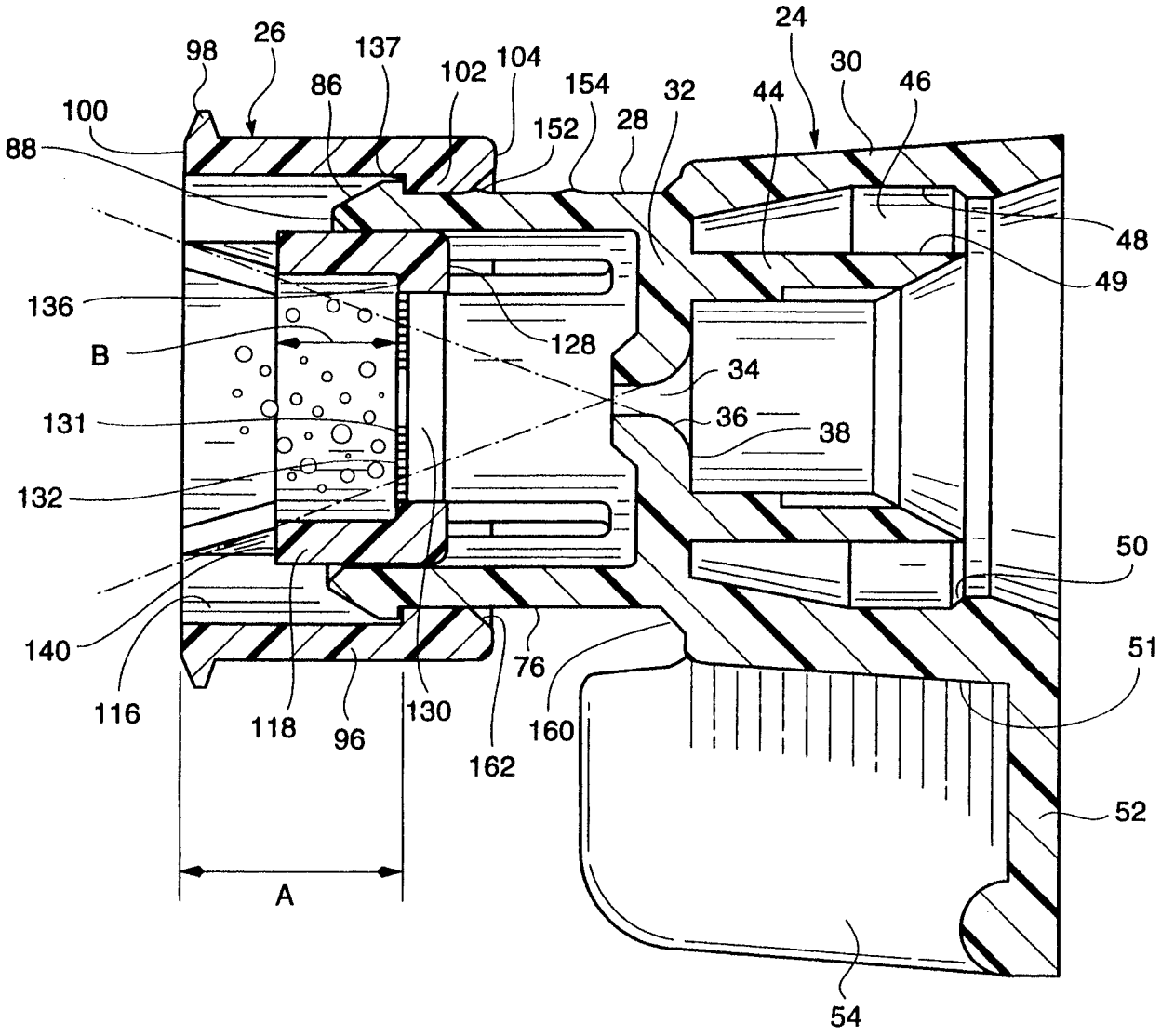
FIG. 6 is a vertical sectional view, similar to the view of the nozzle assembly shown in FIG. 5, but shows a barrel with perforated end wall member of the assembly moved outwardly of a nozzle member of the assembly to a foam generating position.

As best shown in FIG. 6, a front edge 142 of each of the webbings 111–113 extends axially and radially at an angle to the elongate axis of the nozzle assembly 12 from the short inner cylinder 118 to the front edge 100 of the cylindrical body 96.

The partially cylindrical wall sections 81–83 of the front barrel portion 28 of the nozzle member 24 extend through the arcuate slots 121–123 as shown in FIGS. 7 and 8.

Figure 5:
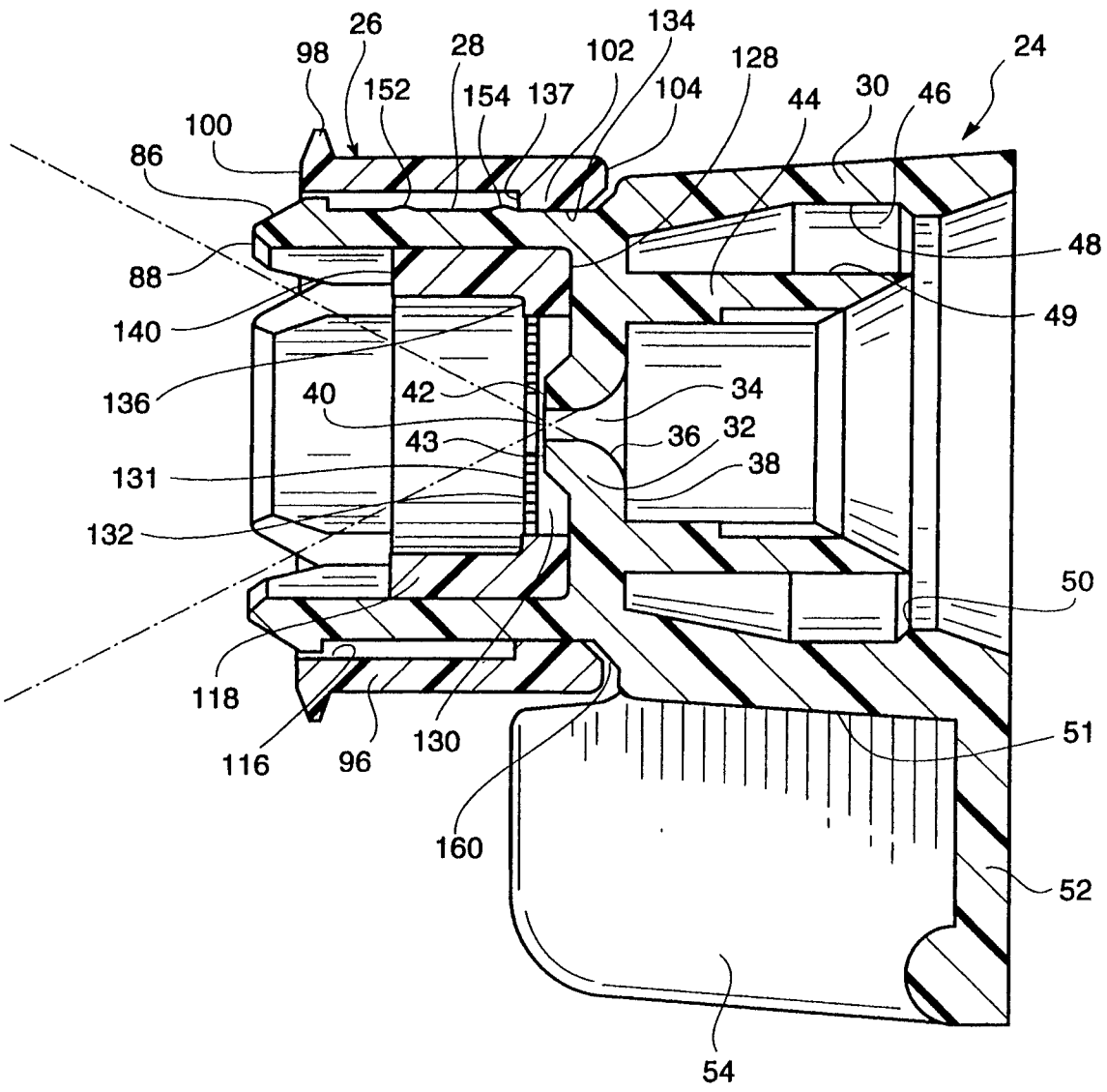
FIG. 5 is a vertical sectional view of the nozzle assembly shown in FIG. 4 and is taken along line 5—5 of FIG. 4.

As shown in FIGS. 5 and 6, the outer surface of the front barrel portion 28 can have axially spaced circumferentially extending detents or ribs 152 and 154 over which the flange portions 102 are moved for locking the barrel with perforated end wall member 26 in a rear position (FIG. 5) or a forward position (FIG. 6).

Preferably, a transition surface 160 is provided between the front and rear barrel portions 28 and 30 which is beveled or conical and the radially inwardly extending surface of the rear edge 104 of the cylindrical body 96 has an inwardly tapered portion 162 which is adapted to mate with the surface 160 as shown in FIG.'s 5 and 6.

FIG. 5 shows the barrel with perforated end wall member 26 in its inner position where the raised boss 42 on the front face 40 of the internal wall 32, and having the orifice 34 therein, is received in the cavity 130 adjacent the central opening 133 in the perforated wall 132. This is the spray made position where the liquid exiting the orifice 34 is a conical spray is not obstructed by the perforated wall 132, the outer front edge 140 of the short cylinder 118 or the outer front edge 88 of the front barrel portion 28.

As shown in FIG. 6, when the barrel with perforated end wall member 26 is in its outer position, a conical spray of liquid from the orifice 34 impinges upon the perforated wall 132, is deflected into droplets that mixes with air and forms foam which accumulates in and is dispensed from the short cylinder 118. Note that the three slots 121, 122 and 123 serve an additional function of defining air inlet means to the space in the front barrel portion 28 between the orifice 34 and the perforated wall 132.

From the foregoing description, it will be apparent that the foam spray trigger sprayer 10, and particularly the nozzle assembly 12 thereof, of the present invention has a number of advantages, some of which have been described above and others of which are inherent in the invention. Also it will be understood that modifications can be made to the nozzle assembly 12 described above without departing from the teachings of the present invention. Accordingly, the scope of the invention is only to be limited as necessitated by the accompanying claims.

We claim:

1. A nozzle assembly for a foam-spray-off trigger sprayer comprising:

a barrel with perforated end wall member;

a nozzle member which has an elongate central axis and which is constructed to be mounted on the outer end of a nose bushing having liquid direction structure for directing liquid into a swirl, said nozzle member having a rear barrel portion and a front barrel portion with an internal wall therebetween, said internal wall having an orifice therethrough located on said central axis and being located to receive swirling liquid from the nose bushing for injection into said front barrel portion, and said barrel with perforated end wall member including an outer hollow cylindrical body and a transversely extending perforated wall mounted in said cylindrical body; and, mounting means for mounting said barrel with perforated end wall member for axial movement on the relative to said front barrel portion comprising said front barrel portion of said nozzle member having at least two axially extending slots therein and said barrel with perforated end wall member having at least two radially extending webbings or flanges connected to said cylindrical body which are adapted to be received in said two slots for facilitating longitudinal sliding movement of said barrel with perforated end wall member relative to said front barrel portion of said nozzle member.

2. The nozzle assembly of claim 1 wherein said front barrel portion has an opening therein for supplying air to the interior of the nozzle assembly, namely to a foam generating chamber defined in said front barrel portion and between an outer position of said perforated wall and said internal wall.

3. The nozzle assembly of claim 1 wherein said barrel with perforated end wall member and said nozzle member are constructed and arranged so that the barrel with perforated end wall member is axially movable in or relative to said front barrel portion from a spray position where said perforated wall is located adjacent said outlet orifice and a foam position where said perforated wall is positioned forwardly of said outlet orifice in said internal wall.

4. The nozzle assembly of claim 1 wherein said perforated wall has a central opening therein which mates with said outlet orifice in said internal wall to allow liquid to be ejected in a spray from said nozzle assembly through said perforated wall.

5. The nozzle assembly of claim 1 wherein said perforated wall is located in a wall in said cylindrical body and is defined by interconnecting ribs with spaces therebetween whereby, when said perforated wall is in its forward position, liquid that is ejected from said outlet orifice in a spray impinges upon said ribs, mixes with air and comes through said perforated wall in a foam.

6. The nozzle assembly of claim 5 wherein said perforated wall has at least three concentric circular ribs and at least three radial or spoke like ribs.

7. The nozzle assembly of claim 6 wherein said perforated wall has four concentric circular ribs with arcuate spaces therebetween.

8. The nozzle assembly of claim 5 wherein said ribs of said perforated wall facing rearwardly toward said outlet orifice are rounded to facilitate deflection of droplets of liquid and mixing of the liquid droplets with air to create foam that passes through said perforated wall and out of said nozzle assembly.

9. The nozzle assembly of claim 1 wherein said slots in said front barrel portion form air inlets to a foam generating chamber defined within said front barrel portion when said barrel with perforated end wall member is in its forward position.

10. The nozzle assembly of claim 1 wherein said barrel with perforated end wall member is snap-fittingly received onto said front barrel portion of said nozzle member and said front barrel portion of said nozzle member and said barrel with perforated end wall member have cooperating stop means for limiting relative movement between said barrel with perforated end wall member and said front barrel portion and for releasably holding said barrel with perforated end wall member in each of its two positions, one being a spray position where said perforated wall is located adjacent said orifice and the other position being a foam generating position where said perforated wall is located forwardly of said orifice.

11. A nozzle assembly for a foam-spray-off trigger sprayer comprising:

a barrel with perforated end wall member;

a nozzle member which has an elongate central axis and which is constructed to be mounted on the outer end of a nose bushing having liquid direction structure for directing liquid into a swirl, said nozzle member having a rear barrel portion and a front barrel portion with an internal wall therebetween, said internal wall having an orifice therethrough located on said central axis and being located to receive swirling liquid from the nose bushing for injection into said front barrel portion;

said barrel with perforated end wall member including an outer hollow cylindrical body and a transversely extending perforated wall mounted in said cylindrical body;

mounting means for mounting said barrel with perforated end wall member for axial movement on and relative to said front barrel portion;

said barrel with perforated end wall member having a short cylinder mounted within said cylindrical body and said perforated wall forming part of a rear wall thereof; and, said mounting means comprising said cylindrical body having three arcuately equally spaced webbings extending radially inwardly from said cylindrical body to said short inner cylinder thereby defining arcuate spaces therebetween through which partially cylindrical sections defined between three axially extending slots in said front barrel portion can extend with said webbings being received and movable in said slots of said front barrel portion of said nozzle member.

12. A nozzle assembly for a foam-spray-off trigger sprayer comprising:

a barrel with perforated end wall member;

a nozzle member which has an elongate central axis and which is constructed to be mounted on the outer end of a nose bushing having liquid direction structure for directing liquid into a swirl, said nozzle member having a rear barrel portion and a front barrel portion with an internal wall therebetween, said internal wall having an orifice therethrough located on said central axis and being located to receive swirling liquid from the nose bushing for injection into said front barrel portion, and said barrel with perforated end wall member including an outer hollow cylindrical body and a transversely extending perforated wall mounted in said cylindrical body; and, mounting means for mounting said barrel with perforated end wall member for axial movement on and relative to said front barrel portion comprising said cylindrical body of said barrel with perforated end wall member having three equidistantly spaced webbings and said front barrel portion of said nozzle member having three equidistantly spaced axially extending slots therein for receiving said webbings of said barrel.

13. The nozzle assembly of claim 12 wherein said barrel with perforated end wall member includes a short inner cylinder to which said webbings are connected, said short cylinder having a rear wall having said perforated wall formed therein.

14. The nozzle assembly of claim 13 wherein said rear wall has a cutaway portion on the rear face thereof such that said perforated wall is adjacent the front face of said wall facing into said short cylinder.

15. The nozzle assembly of claim 14 wherein said internal wall of said nozzle member has a raised surface or boss in the front face thereof around said outlet orifice, said raised surface being received in said cutaway area of said rear wall of said short cylinder.

* * * * *